US011381039B2

(12) United States Patent
Hsiao et al.

(10) Patent No.: US 11,381,039 B2
(45) Date of Patent: Jul. 5, 2022

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Shih-Wei Hsiao, New Taipei (TW); Tsu-Yang Wu, New Taipei (TW); Na Yang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/186,002

(22) Filed: Feb. 26, 2021

(65) Prior Publication Data

US 2021/0265784 A1 Aug. 26, 2021

(30) Foreign Application Priority Data

Feb. 26, 2020 (CN) ..... 202010120121.5

(51) Int. Cl.
*H01R 13/648* (2006.01)
*H01R 13/6471* (2011.01)
*H01R 24/62* (2011.01)

(52) U.S. Cl.
CPC ..... *H01R 13/6471* (2013.01); *H01R 24/62* (2013.01)

(58) Field of Classification Search
CPC ..... H01R 13/6461; H01R 13/6471; H01R 24/62; H01R 24/64
USPC ..... 439/607.28
See application file for complete search history.

(56) References Cited

U.S. PATENT DOCUMENTS

| | | | |
|---|---|---|---|
| 8,545,240 | B2 | 10/2013 | Molex |
| 8,764,464 | B2 | 7/2014 | Buck et al. |
| 8,944,849 | B1 | 2/2015 | Fit |
| 9,640,915 | B2 | 5/2017 | Phillips et al. |
| 10,103,501 | B2 | 10/2018 | Lin et al. |
| 10,498,091 | B2 | 12/2019 | Xu et al. |

(Continued)

FOREIGN PATENT DOCUMENTS

| | | | |
|---|---|---|---|
| CN | 210224355 | U | 3/2020 |
| CN | 211579030 | U | 9/2020 |
| JP | 4234714 | B2 | 3/2009 |

*Primary Examiner* — Khiem M Nguyen
(74) *Attorney, Agent, or Firm* — Ming Chieh Chang; Wei Te Chung

(57) ABSTRACT

An electrical connector includes an insulative housing with a base and a mating tongue forwardly extending from the base in a front-to-back direction, and a plurality of contacts retained in the housing. The contacts include a plurality of differential-pair contacts and a plurality of grounding contacts alternately arranged with each other in the transverse direction. A metallic grounding plate is forwardly inserted into the horizontal center slot of the mating tongue with at least two sets of spring tangswelded to spaced positions of the corresponding grounding contacts, respectively so as to have each grounding contacts mechanically and electrically connected with the grounding plate at at least two spaced positioned in the front-to-back direction.

20 Claims, 7 Drawing Sheets

(56) References Cited

U.S. PATENT DOCUMENTS

2009/0221165 A1* 9/2009 Buck ..... H01R 12/724
439/108
2013/0316581 A1* 11/2013 Kao ..... H01R 13/6585
439/607.28

* cited by examiner

ELECTRICAL CONNECTOR

BACKGROUND OF THE INVENTION

1. Field of the Invention

The present invention relates to an electrical connector, and particularly to the electrical connector for high frequency transmission.

2. Description of Related Arts

US application publication number 20090221165 discloses an electrical connector equipped with a grounding bar for enhancing electrical performance. Anyhow, currently the transmission speed will become 32GT/s and the transmission bandwidth will become 128 Gbps so such a simple grounding bar with the single contacting point for the corresponding grounding contact may not satisfy the required criteria.

Therefore, it is desired to provide an electrical connector with an improved grounding bar for achieving the required performance under the aforementioned transmission criteria.

SUMMARY OF THE INVENTION

An electrical connector includes an insulative housing with a base and a mating tongue forwardly extending from the base in a front-to-back direction, and a plurality of contacts retained in the housing. The contacts include a plurality of differential-pair contacts and a plurality of grounding contacts alternately arranged with each other in the transverse direction. A metallic grounding plate is forwardly inserted into the horizontal center slot of the mating tongue with at least two sets of spring tangs welded to spaced positions of the corresponding grounding contacts, respectively so as to have each grounding contacts mechanically and electrically connected with the grounding plate at at least two spaced positioned in the front-to-back direction.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
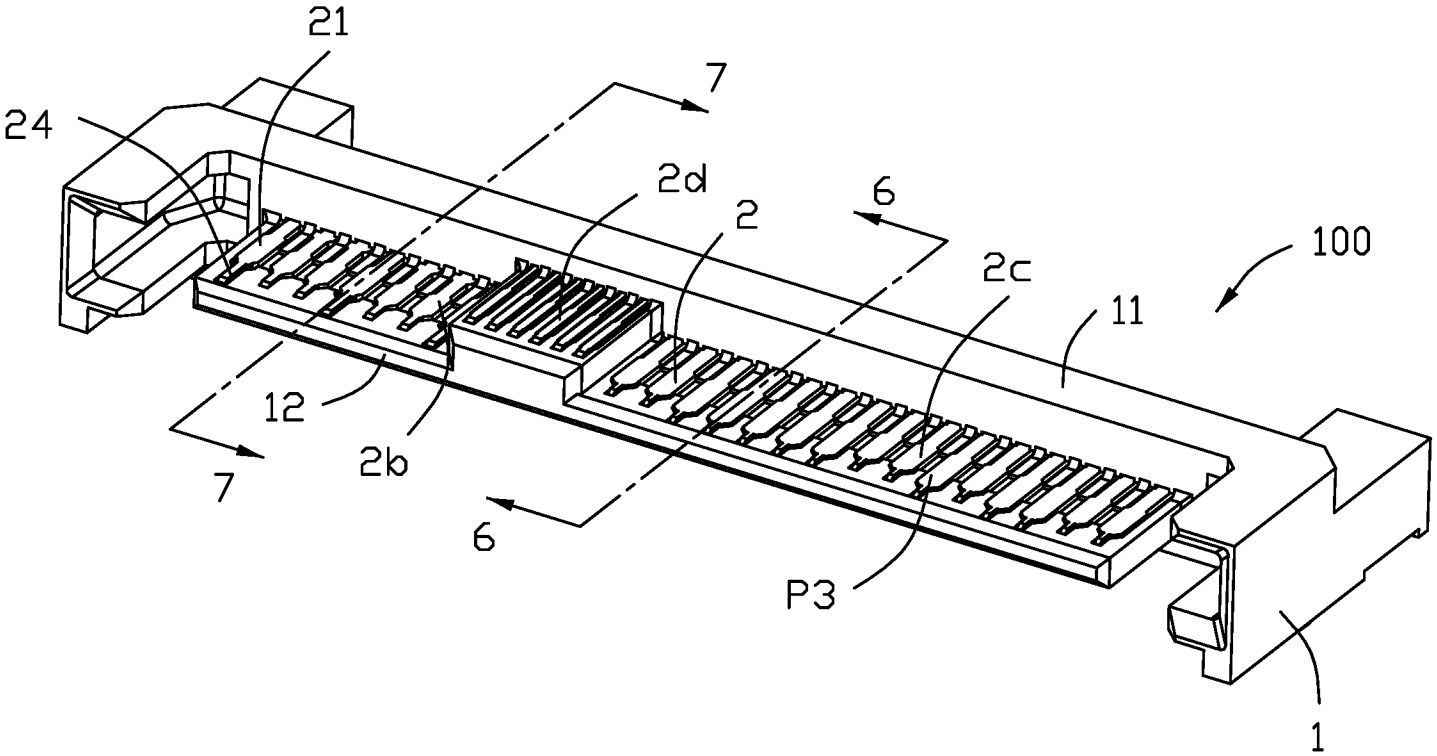
FIG. 1 is a perspective view of an electrical connector according to the invention.
Figure 2:
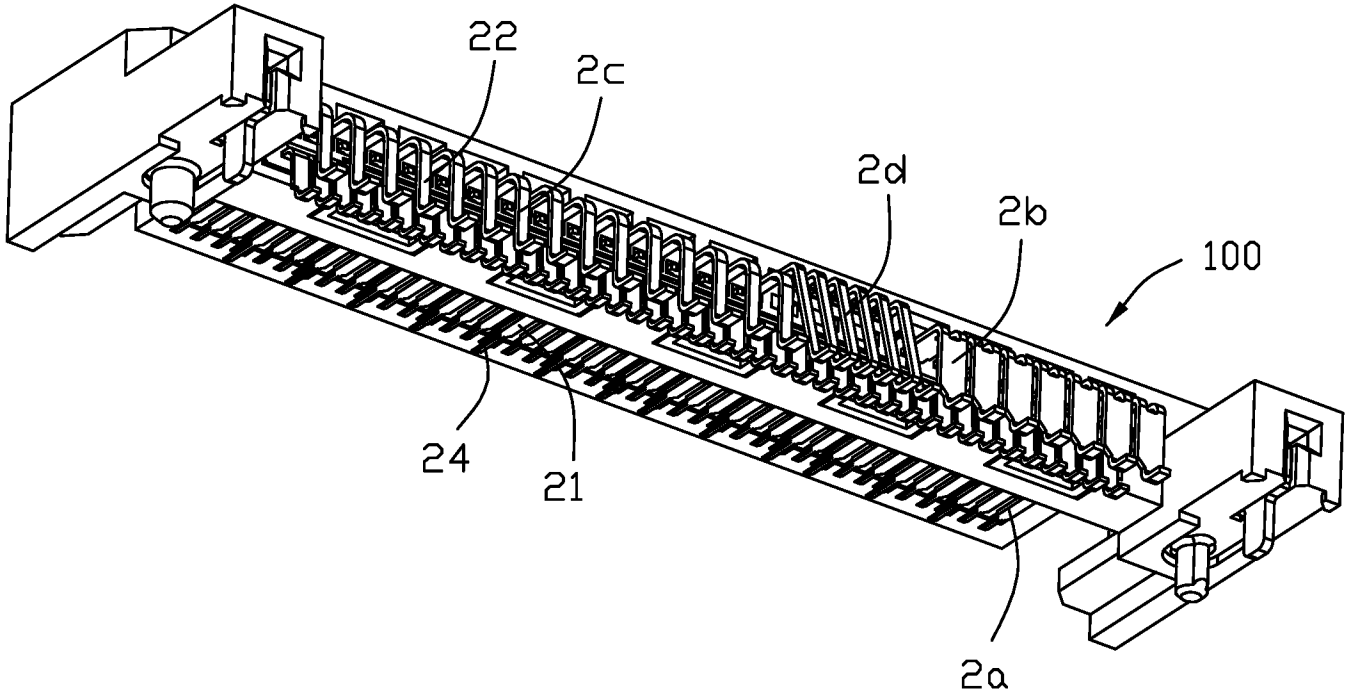
FIG. 2 is another perspective view of the electrical connector of FIG. 1.
Figure 3:
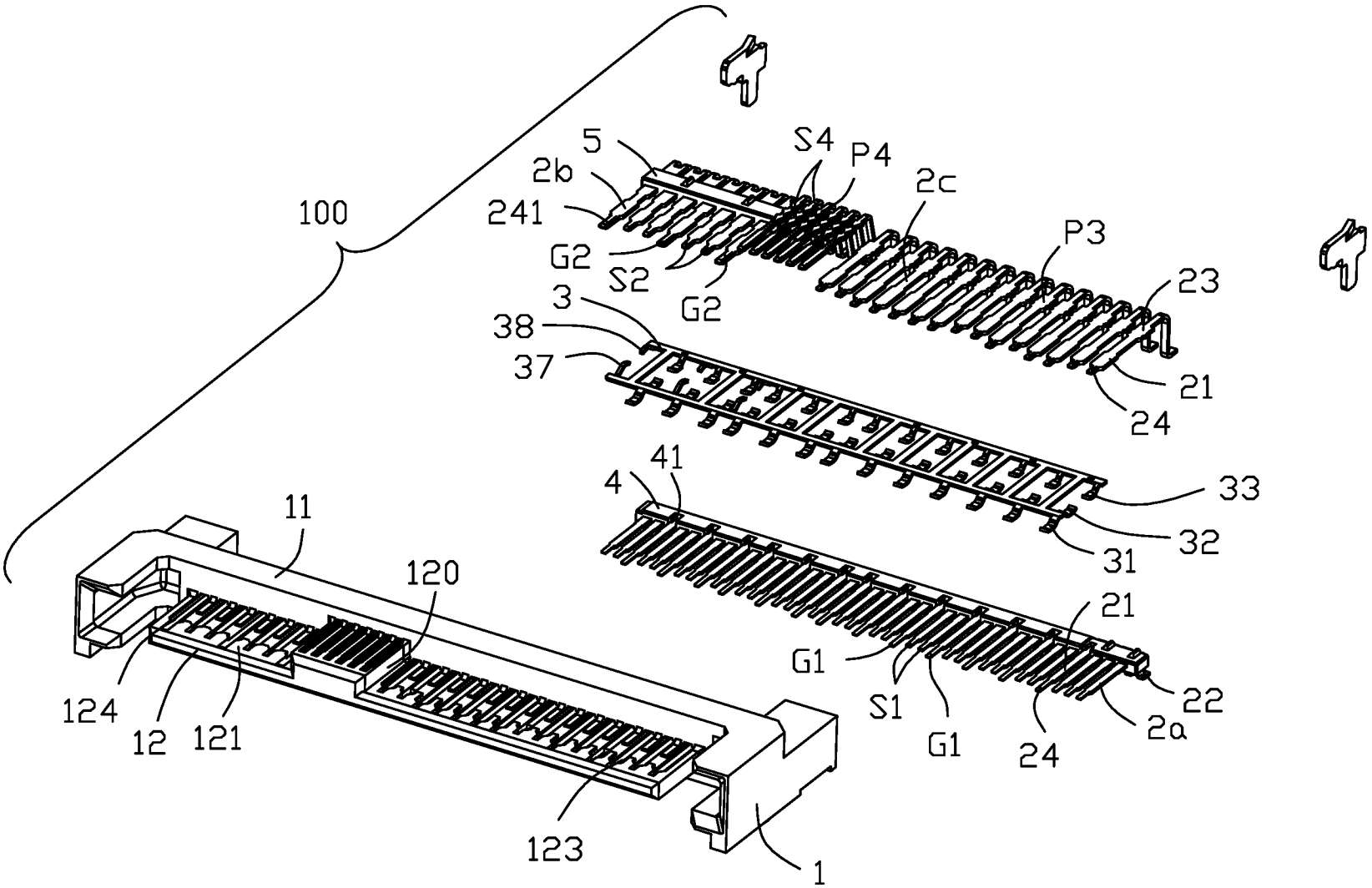
FIG. 3 is an exploded perspective view of the electrical connector of FIG. 1.
Figure 4:
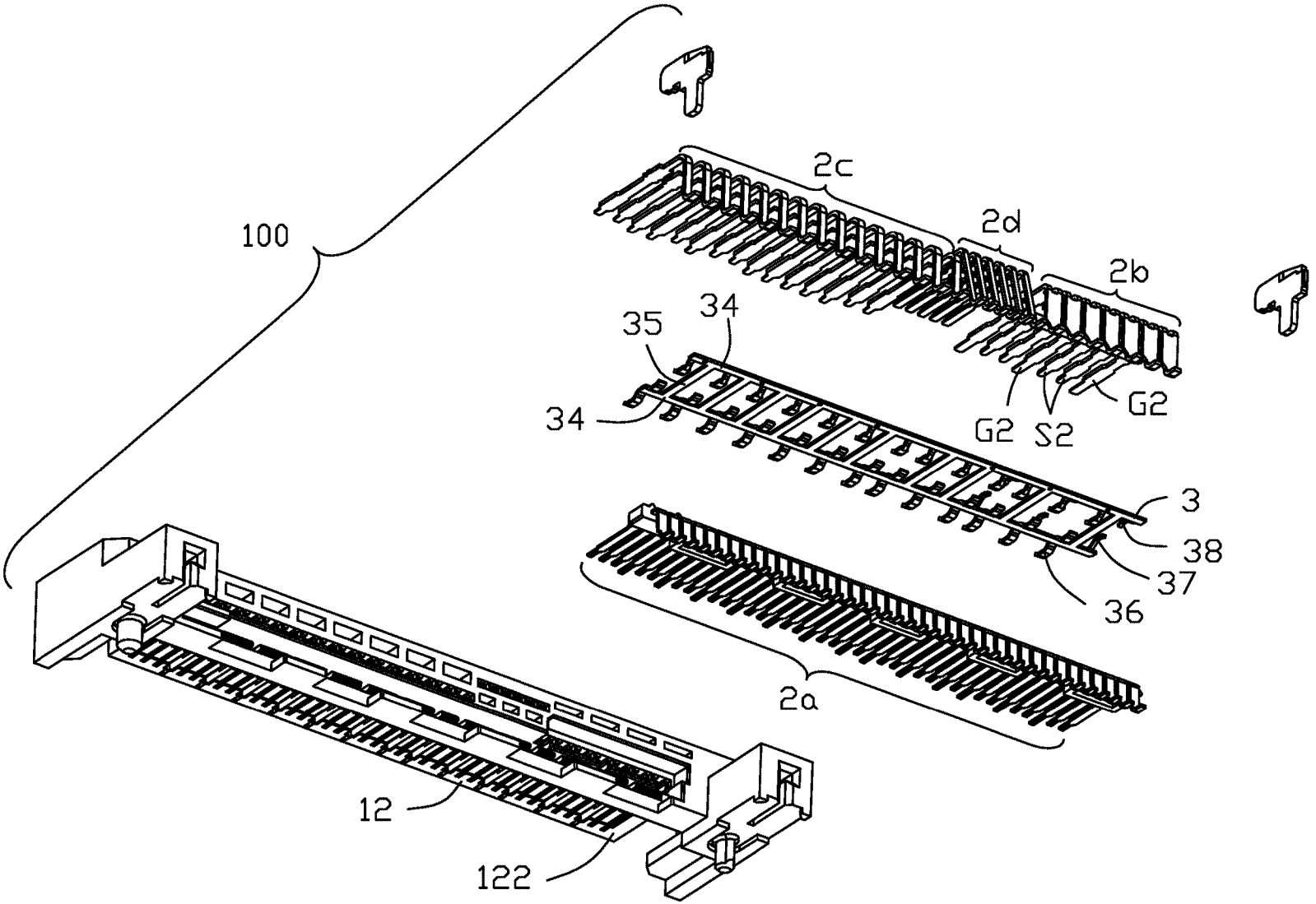
FIG. 4 is another exploded perspective view of the electrical connector of FIG. 3.
Figure 5:
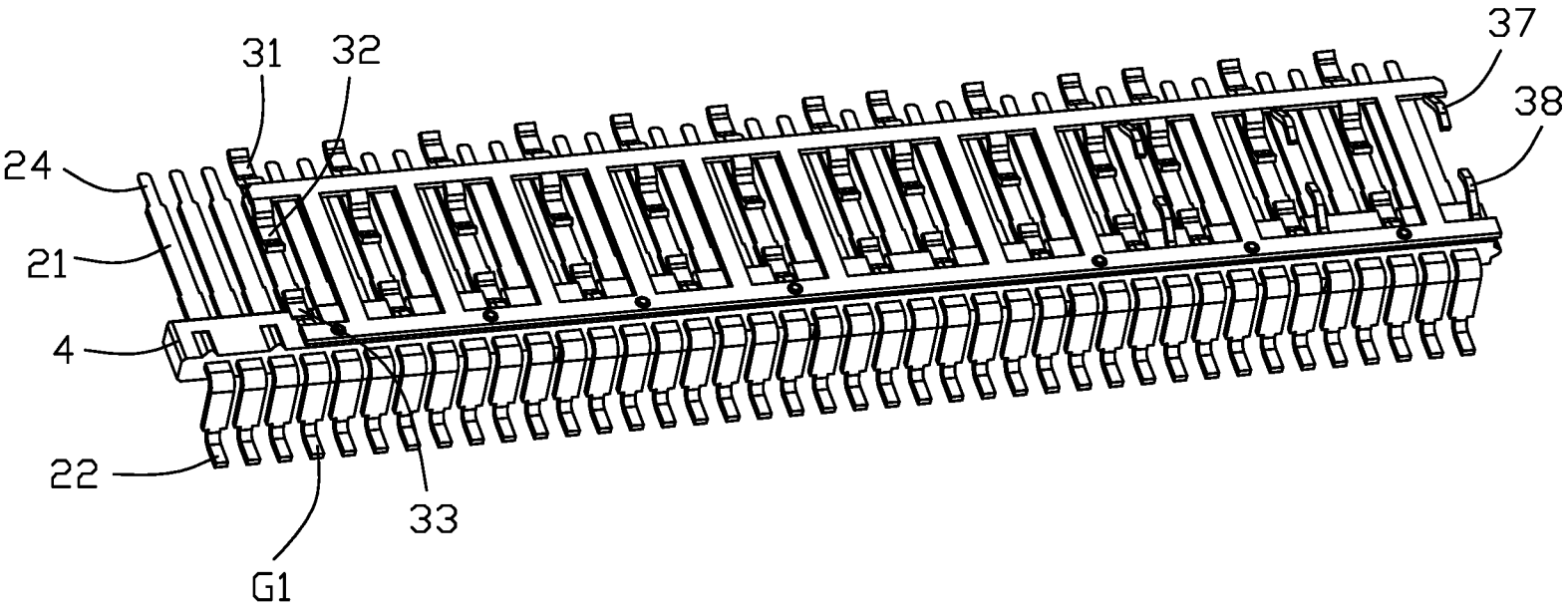
FIG. 5 is a perspective view of a combination including the grounding plate and the first set of contacts of the electrical connector of FIG. 1.
Figure 6:
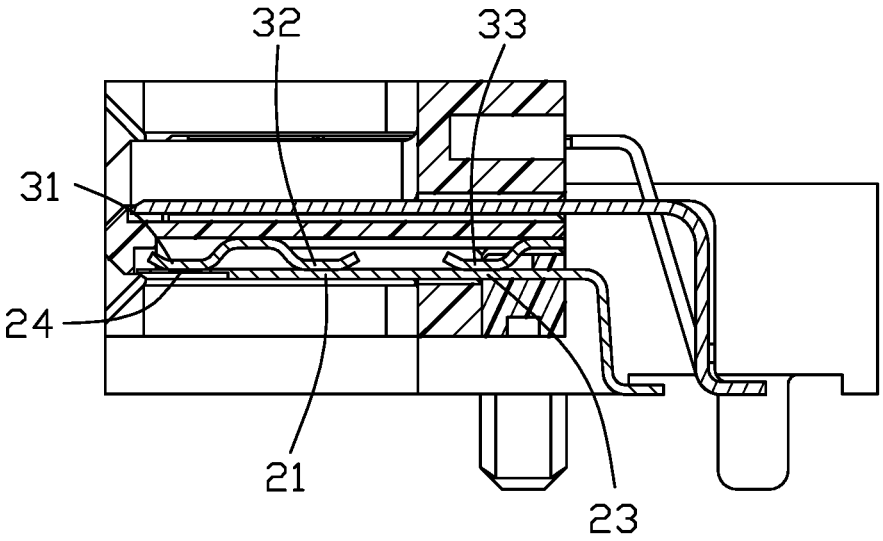
FIG. 6 is a cross-sectional view of the electrical connector of FIG. 1 along line 6-6 to show how the grounding plate cooperates with the first set of contacts.

An electrical connector 100 includes an insulative housing 1, a plurality of contacts 2 retained to the housing 1, a metallic grounding plate 3, a first insulator 4 and a second insulator 5. The contacts 2 includes a plurality of differential-pair contacts S1 and a plurality of grounding contacts S2 alternately arranged with each other along the transverse direction. The grounding plate 3 includes a plurality of first spring tangs 31, second spring tangs 32 and third spring tangs 33 to be welded to different positions of the corresponding grounding contacts G1, respectively.

In detail, the housing 1 includes a base 11 and a mating tongue 12 forwardly extending from the base 11 in the front-to-back direction. The mating tongue 12 forms opposite upper face 121 and lower face 122. A plurality of passageways 123 are formed in the upper face 121 and the lower face 122. A raised portion 120 is formed on the upper face 121. The contact 2 includes a contacting section 21 received in the passageway 123, a tail 22 extending outside of the housing 1, and a retaining section 23 between the contacting section 21 and the tail 22. A narrowed section 24 is formed at a front end of the contacting section 21 with flanges 241 on two sides. The passageway 123 forms the corresponding block 124 for compliance with the flanges 241.

The contacts 2 are forwardly assembled into the housing 1 from a rear side of the housing 1, and includes a first set of contact 2*a* occupying all the lower face 122, and a second set of contacts 2*b*, a third set of contacts 2*c* and a fourth set of contacts 2*d* commonly sharing the upper face 121 wherein the four set of contacts 2*d* are located on the raised portion 120 and the second set of contacts 2*b* and the third set of contacts 2*c* are respectively located by two sides of the raised portion 120.

The first set of contacts 2*a* includes a plurality of differential-pair contacts S1 and a plurality of grounding contacts G1 alternately arranged with each other in the transverse direction as well as the differential-pair contacts S2 and the grounding contacts G2 of the second set of contacts 2*b* and the differential-pair contacts S4 and the grounding contacts G4 of the fourth set of contacts 2*d* while all the third set of contacts 2*c* are the power contacts P3.

The grounding plate 3 is forwardly assembled into the housing 1 and essentially located at a center position of the mating tongue 12 so as to be located between the first set of contacts 2*a* and the other contacts 2*b*, 2*c* and 2*d* in the vertical direction. The grounding plate 3 is essentially of a frame structure with front and rear transverse bars 34 linked by a plurality of bridges 35. The transverse bars 34 extend in the transverse direction while the bridges extend in the front-to-back direction. The first spring tangs 31, the second spring tangs 32 and the third spring tangs 33 extend downwardly from the transverse bar 34 wherein the first spring tang 31 and the second sprint tang 32 respectively extend forwardly and rearwardly from the front transverse bar 31, and the third spring tang 33 extends forwardly from the rear transverse bar 31. Each grounding contact G1 mechanically and electrically contacts all the corresponding first spring tang 31, the second spring tang 32 and the third spring tang 33 at different positions for reducing the electromotive force difference along the grounding contact G1 and eliminating the crosstalk. In a top view, the first spring tang 31, the second spring tang 32 and the third spring tang 33 are aligned with one another in the front-to-back direction, while the bridge 35 is located between the two contacts of the corresponding pair of the differential-pair contacts. Also, in a top view, in the grounding plate 3, a plurality of rectangular frame structures are formed by cooperation of the transverse bars 34 and the corresponding bridges 35.

Each frame structure receives at least one second spring tang and one third spring tang therein.

The first spring tang 31 contacts the narrowed section 24, the second spring tang 32 contacts the contacting section 21, and the third spring tang 33 contacts the retaining section 23. The distance between the contact area 36 of the first spring tang 31 and the contact area 36 of the second spring tang 32 is smaller than the distance between the contact area 36 of the second spring tang 32 and the contact area 36 of the third spring tang 33. Notably, the spot welding may be applied upon the contact area 36 for securing the spring tang to the grounding contact G1.

The front and rear transverse bars 31 further include a plurality of fourth spring tangs 37 and fifth spring tangs 38 upwardly extend therefrom to contact the contacting sections 21 and the retaining sections 23 of the corresponding grounding contacts G2 of the second set of contacts 2*b*. Via cooperation of all the first spring tangs 31, the second spring tangs 32, the third spring tang 33, the fourth spring tangs 34 and the fifth spring tangs 35, a circuit loop for grounding is formed. In this embodiment, the width of the first set of contacts 2*a* is smaller than that of the second set of contacts 2*b*. In opposite, the widths of the first, second third spring tangs 31, 32, 33 which work with the first set of contacts 2*a*, are larger than those of the fourth and fifth spring tangs 37, 38 which work with the second set of contacts 2*b*.

Figure 7:
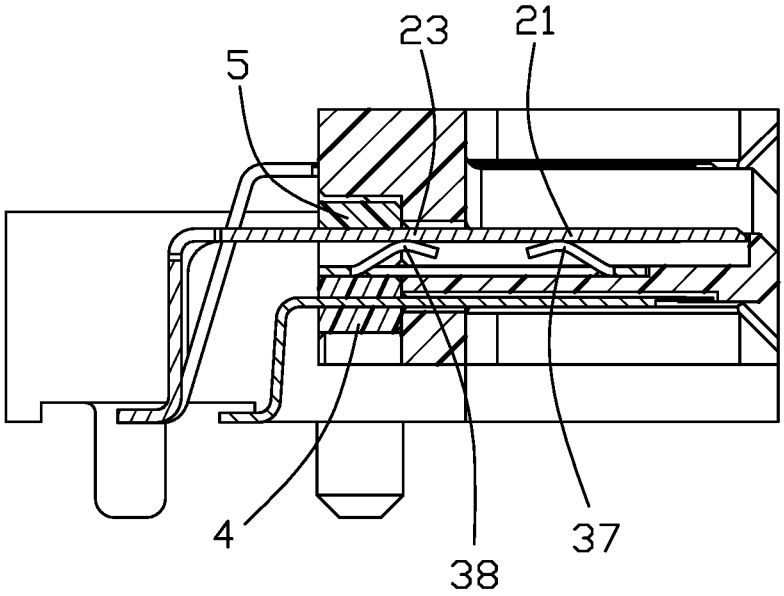
FIG. 7 is a cross-sectional view of the connector connector of FIG. 1 to show how the grounding plate cooperates with the second set of contacts.

All first set of contacts 2*a* are integrally formed, via insert-molding, within a first insulator 4 which is located behind the housing 1. The first insulator 4 forms a plurality of recesses 41 to receive the corresponding third spring tangs 33 so as to allow the increased distance between the contact area of the second spring tang 32 and that of the third spring tang 33 for better electrical performance. Similarly, all second set of contacts 2*b* are integrally formed, via insert-molding, within a second insulator 5 located behind the housing 1. The second insulator 5 also forms a plurality of recesses (not labeled) to receive the corresponding fifth spring tang 38 as shown in FIG. 7. The rear region of the grounding plate 3 can be sandwiched between the first insulator 4 and the second insulator 5 in the vertical direction. Differently, both the third set of contacts 2*c* and the fourth set of contacts 2*d* are directly secured to the housing 1 without involvement of any insulator. It is also understood that the mating tongue 12 forms a plurality of cavities (not labeled) in aligned with the corresponding grounding contacts in the vertical direction to allow the corresponding spring tangs to extend.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing including a base and a mating tongue extending forwardly from the base in a front-to-back direction, the mating tongue defining opposite upper and lower faces in a vertical direction perpendicular to the front-to-back direction;

a plurality of passageways formed in the housing;

a first set of contacts disposed in the corresponding passageways at a lower side of the mating tongue and including a plurality of differential-pair contacts and a plurality of grounding contacts alternately arranged with each other along a transverse direction perpendicular to both the front-to-back direction and the vertical direction, each of first set of contacts including a contacting section exposed upon the lower face of the mating tongue, a tail exposed outside of the housing and a retaining section therebetween;

a metallic grounding plate forwardly inserted into the mating tongue at a center level and including opposite front and rear transverse bars spaced from each other in the front-to-back direction and each transverse bar extending in the transverse direction; and a plurality of first spring tangs forwardly extending downwardly from the front transverse bar, a plurality of second spring tangs rearwardly extending downwardly from the front transverse bar, and a plurality of third spring tangs forwardly extending downwardly from the rear transverse bar; wherein each grounding contact mechanically and electrically connects to one of said first spring tangs, one of said second spring tangs and one of said third spring tangs at different positions in the front-to-back direction.

2. The electrical connector as claimed in claim 1, wherein each contact further includes a narrowed section at a front end of the contacting section, and the corresponding first spring tang contacts the narrowed section, the second spring tang contacts the contacting section, and the third spring tang contacts the retaining section.

3. The electrical connector as claimed in claim 2, wherein the front transverse bar and the rear transverse bar are connected via a plurality of bridges each extending in the front-to-back direction.

4. The electrical connector as claimed in claim 3, wherein in a top view along the vertical direction, the bridge is located between two contacts of each corresponding pair of the differential-pair contacts.

5. The electrical connector as claimed in claim 1, wherein the first set of contacts are integrally formed, via insert-molding, within a first insulator which is located behind the housing, and the first insulator forms a plurality of recesses to receive the corresponding third spring tangs, respectively.

6. The electrical connector as claimed in claim 1, wherein to each grounding contact, the corresponding first sprint tang, second spring and third spring tang are welded for securing.

7. The electrical connector as claimed in claim 1, further including a second set of contacts disposed in the corresponding passageways at an upper side of the mating tongue, wherein said second set of contacts includes a plurality of differential-pair contacts and a plurality of grounding contacts alternately arranged with each other in the transverse direction, each of the second set of contacts including a contacting section exposed upon an upper face of the mating tongue and a retaining section hidden in the base, and the grounding plate further includes a plurality of fourth spring tangs rearwardly extending upwardly from the front transverse bar and a plurality of fifth spring tangs forwardly extending upwardly from the rear transverse bar to mechanically and electrically connect to the corresponding grounding contacts of the second set of contacts, and each grounding contact of the second set of contacts connects the corresponding fourth sprint tang at the contacting section thereof and the corresponding fifth sprint tang at the retaining section thereof.

8. The electrical connector as claimed in claim 7, wherein the second set of contacts are integrally formed, via insert-molding, by a second insulator, and the second insulator forms a plurality of recesses to receive the corresponding fifth spring tangs therein.

9. The electrical connector as claimed in claim 8, wherein a rear region of the grounding plate is sandwiched by the first insulator and the rear insulator in the vertical direction.

10. The electrical connector as claimed in claim 7, wherein a width of the contacting section of each of the second set of contacts is larger than another width of the contacting section of each of the first set of contacts, while a width of the first spring tang or the second spring tang or the third spring tang is larger than another width of the fourth spring tang or the fifth spring tang.

11. The electrical connector as claimed in claim 1, wherein along the front-to-back direction, a distance between a contact area of the first spring tang and a contact area of the second spring tang, is smaller than another distance between the contact area of the second spring tang and a contact area of the third spring tang.

12. An electrical connector comprising:

an insulative housing including a base and a mating tongue forwardly extending from the base in a front-to-back direction, the mating tongue defining opposite upper face and lower face in a vertical direction perpendicular to the front-to-back direction;

a plurality of passageways formed in the housing;

a first set of contacts received within the corresponding passageways, respectively, each contact including a contacting section exposed upon one of the upper face and the lower face of the mating tongue, a tail extending outside the housing, and a retaining section therebetween embedded within the base, a narrowed section formed at a front end of the contacting section, the first set of contacts including a plurality of differential-pair contacts and a plurality of grounding contacts alternately arranged with each other in a transverse direction perpendicular to both the front-to-back direction and the vertical direction;

a metallic grounding plate including a plurality of first spring tangs, a plurality of second spring tangs, and a plurality of third spring tangs extending therefrom; wherein each grounding contact contacts one of the first spring tangs at the narrowed section, one of the second spring tangs at the contacting section, and one of the third spring tangs at the retaining section.

13. The electrical connector as claimed in claim 12, wherein the first set of contacts are integrally, via insert-molding, formed within a first insulator which is located behind the base and includes a plurality of recesses to receive the corresponding third spring tangs, respectively.

14. The electrical connector as claimed in claim 13, wherein the second spring tangs are located between the first spring tangs and the third spring tangs in the front-to-back direction, and both the first spring tangs extend forwardly while the second spring tangs extend rearwardly.

15. The electrical connector as claimed in claim 14, wherein both the first sprint tangs and the second sprint tangs extend from a front transverse bar while the third sprint tangs extend from a rear transverse bar.

16. The electrical connector as claimed in claim 15, wherein the front transverse bar and the rear transverse bar are connected with each other by a plurality of bridges each extending in the front-to-back direction.

17. The electrical connector as claimed in claim 16, wherein in a top view along the vertical direction, each bridge is located between two contacts of each pair of differential-pair contacts.

18. The electrical connector as claimed in claim 13, further including a second set of contacts having corresponding contacting sections exposed upon the other of the upper face and the lower face of the mating tongue, wherein the second set of contacts are integrally, via insert-molding, formed within a second insulator, the grounding plate further includes a plurality of fourth spring tangs and a plurality of fifth spring tangs extending toward each other to mechanically and electrically connect grounding contacts of the second set of contacts.

19. The electrical connector as claimed in claim 18, wherein the second insulator forms a plurality of recesses to receive the corresponding fifth spring tangs, and a rear region of the grounding plate is sandwiched between the first insulator and the second insulator in the vertical direction.

20. A metallic grounding plate for use within an electrical connector having a mating tongue, said grounding plate comprising:

opposite front and rear transverse bars spaced from each other in a front-to-back direction;

a plurality of bridges linked between the pair of transverse bars and extending in the front-to-back direction so as to form a plurality of rectangular frame structures thereof;

a plurality of first spring tangs extending forwardly from the front transverse bar;

a plurality of second spring tangs extending rearwardly from the front transverse bar; and a plurality of third spring tangs extending forwardly from the rear transverse bar; wherein each first spring tang is aligned with one of the second spring tangs and one of the third spring tangs in the front-to-back direction, and each frame structure receives at least one of the second spring tangs and one of the third spring tangs.

* * * * *